US007886446B2

(12) United States Patent
Yu Chen

(10) Patent No.: US 7,886,446 B2
(45) Date of Patent: Feb. 15, 2011

(54) PIPE CUTTING PINCERS

(76) Inventor: Hsiu-Man Yu Chen, No. 40, Sec. 1, Ta Fu Road, Tan Tzu Hsiang, Taichung County (TW)

( * ) Notice: Subject to any disclaimer, the term of this patent is extended or adjusted under 35 U.S.C. 154(b) by 392 days.

(21) Appl. No.: 12/044,341

(22) Filed: Mar. 7, 2008

(65) Prior Publication Data

US 2009/0223059 A1 Sep. 10, 2009

(51) Int. Cl.
*B26B 17/00* (2006.01)

(52) U.S. Cl. ..... 30/175; 30/92; 30/190; 30/261

(58) Field of Classification Search ..... 30/92, 30/261, 262, 258, 236, 178, 175, 190, 229, 30/234

See application file for complete search history.

(56) References Cited

U.S. PATENT DOCUMENTS

| | | | | | |
|---|---|---|---|---|---|
| 109,192 | A * | 11/1870 | Bois | 30/145 |
| 4,058,893 | A * | 11/1977 | Boyajian | 30/250 |
| 4,312,127 | A * | 1/1982 | Tanaka | 30/92 |
| 4,674,184 | A * | 6/1987 | Anderson | 30/92 |
| 5,123,456 | A * | 6/1992 | Jansen | 140/93.4 |
| 5,440,812 | A * | 8/1995 | Nishizuka | 30/175 |
| 6,370,780 | B1 * | 4/2002 | Robertson et al. | 30/261 |
| 6,532,847 | B2 * | 3/2003 | Liou | 81/416 |
| 7,204,021 | B2 * | 4/2007 | Houseman et al. | 30/92 |
| 7,328,513 | B1 * | 2/2008 | Yang | 30/178 |
| 2008/0141538 | A1 * | 6/2008 | Nandkumar et al. | 30/92 |

* cited by examiner

*Primary Examiner*—Boyer D. Ashley
*Assistant Examiner*—Omar Flores-Sánchez
(74) *Attorney, Agent, or Firm*—Pai Patent & Trademark Law Firm; Chao-Chang David Pai

(57) ABSTRACT

A pair of pipe cutting pincers includes a pincers body having a first handle and a second handle pivotally assembled together. The first handle has its front end pivotally combined with a pipe-cutting member disposed with a cutting blade and its rear end bent toward a second receiving groove to form a pivotally driven member. An elastic member positioned between the first and the second handle has one end hooked on the first handle and the other end hooked with the rear end of the pivotally driven member for pulling the pipe-cutting member to carry out reciprocating shifting. A pivotal actuating member is rotatably assembled in the second handle to resist against the lower end of the pivotally driven member. In using, the pivotally driven member is actuated by the elastic member to move and make the pivotal actuating member rotate and drive a cutting edge to cut off a pipe.

9 Claims, 7 Drawing Sheets

PIPE CUTTING PINCERS

BACKGROUND OF THE INVENTION

1. Field of the Invention

This invention relates to a pair of pipe cutting pincers, particularly to one used for cutting off plastic pipe.

2. Description of the Prior Art

A pair of conventional pipe cutting pincers, as shown in FIG. 1, includes a first long shell-shaped handle 1 and a second long shell-shaped handle 2 pivotally assembled at one side of the first handle 1. The first handle 1 has its front end pivotally installed with a blade 3 having its front side formed with a cutting edge 4, letting the front end of the pipe cutting pincers formed with a pincers mouth 5. The blade 3 has its rear end bent and extended toward a location between the first handle 1 and the second handle 2 and the circumferential edge of its rear end formed with saw teeth 6, and a crank 7 has one end secured at the rear end of the blade 3 and the other end fixed on the second handle 2. The second handle 2 is provided with a push key 8 at a location corresponding to the saw teeth 6 of the blade 3, and a torsion spring 9 is disposed on one side of the push key 8 for pushing and resisting the push key 8 to be able to elastically recover its original position. During cutting off a pipe, such as a plastic pipe or a water pipe, firstly, the second handle 2 is pressed to drive the push key 8 to push the saw teeth 6 and actuate the blade 3 to gradually move downward and close the pincers mouth 5. Next, adjust the cutting edge 4 of the blade 3 to clamp the pipe and then apply an axial force upon both the first and the second handle 1, 2 to enable the cutting edge 4 to diametrically cut off the pipe. To cut off a small-diameter pipe, as shown in FIG. 2, the push key 8 is adjusted and moved to the lower end of the toothed member 6 to let the pincers mouth 5 become comparatively small. During cutting the pipe, the second handle 2 is pressed to actuate the push key 8 to push against the saw teeth 6 at its upper end and as a result, the push key 8 will be disengaged from the blade 3, rendering the pipe cutting pincers unable to keep on cutting the pipe. At this time, the pipe is half cut and hence the first handle 1 and the second handle 2 must be stretched outward again to let the push key 8 resist against the toothed member 6 once more, and then the second handle 2 is continuously pressed to drive the push key 8 to push the saw teeth 6, and meanwhile the cutting edge 4 is adjusted to clamp the pipe for carrying out cutting. The conventional pipe cutting pincers are complicated in structure and assembly, and necessary to take a lot of exertion in operation.

SUMMARY OF THE INVENTION

The objective of this invention is to offer a pair of pipe cutting pincers including a pincers body provided with a first handle and a second handle pivotally assembled at one side of the first handle. The first handle has its front end cut with a pivotal groove having its front end extended forward to form a pipe-cutting base at a location near the second handle. A pipe-cutting member (being an L-shaped curve blade) has its curved portion pivotally fixed in the pivotal groove and its front end extended forward and positioned above the pipe-cutting base and disposed thereon with a cutting edge at a location corresponding with the pipe-cutting base, with a pincers mouth formed between the cutting edge and the pipe-cutting base. The pipe-cutting member has its rear end bent and extended toward the second handle to form a pivotally driven member, and an elastic member is disposed between the first and the second handle, having one end hooked with the first receiving groove of the first handle and the other end hooked on the rear end of the pivotally driven member. A pivotal actuating member is assembled at a preset location in the second handle to resist against the lower end of the pivotally driven member. By so designing, when the second handle is axially pressed, the pivotally driven member will be repeatedly pulled by the elastic member to move and make the pivotal actuating member to rotate and actuate the cutting edge to repeatedly cut a pipe, convenient and labor-saving in operation.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
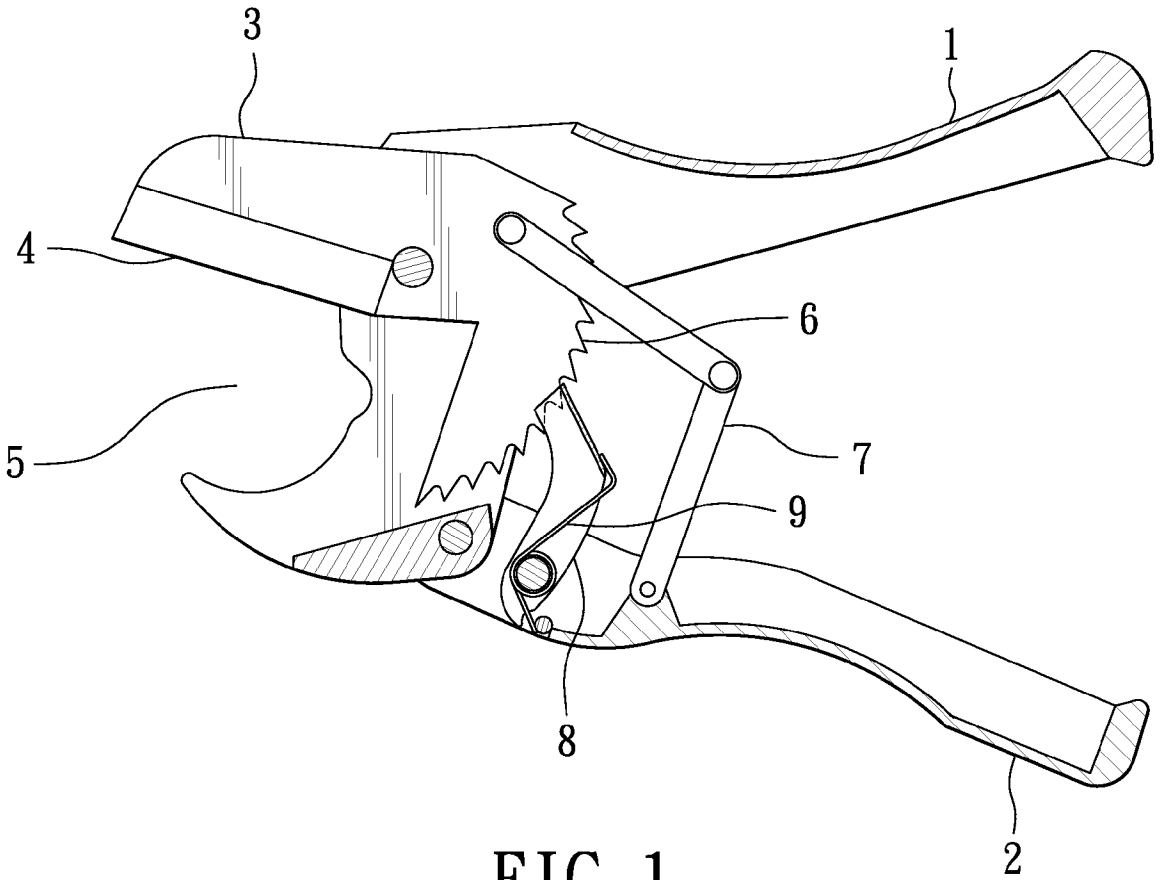
FIG. 1 PRIOR ART
FIG. 1 is a perspective view of a pair of convention a pipe cutting pincers in a first using condition.
Figure 2:
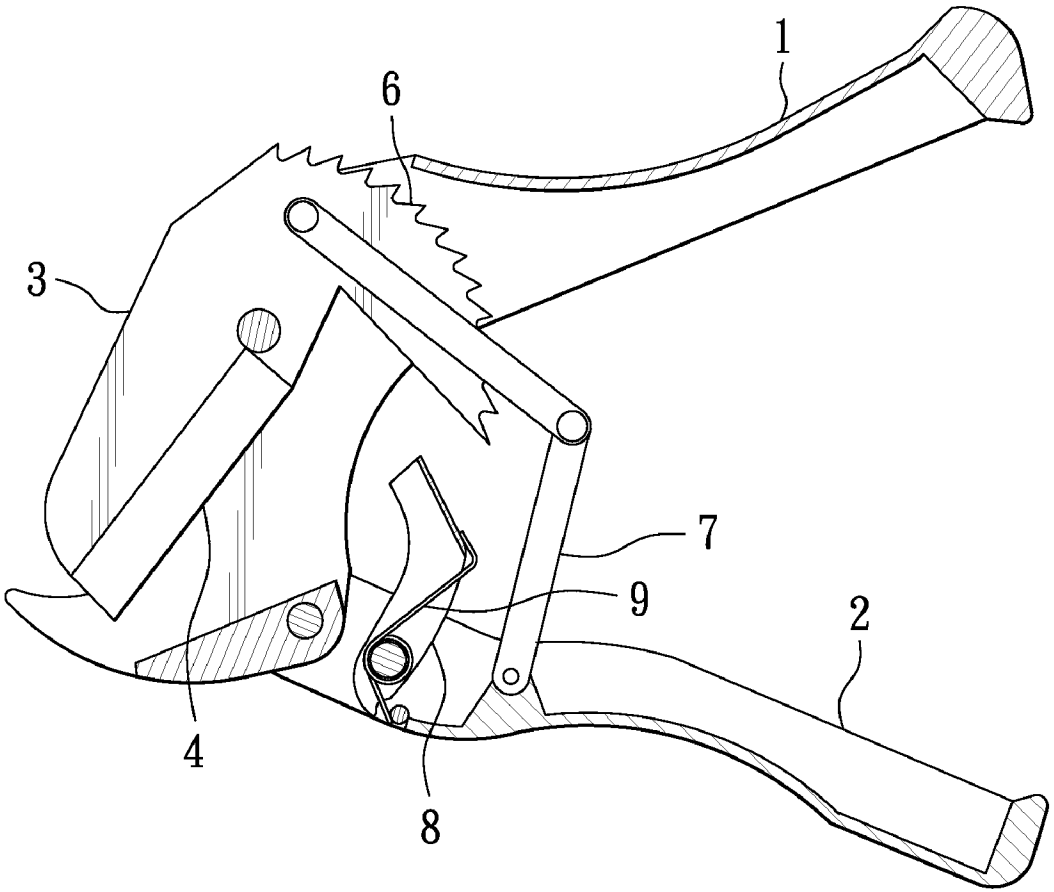
FIG. 2 PRIOR ART
FIG. 2 is a perspective view of the conventional pipe cutting pincers in a second using condition.
Figure 3:
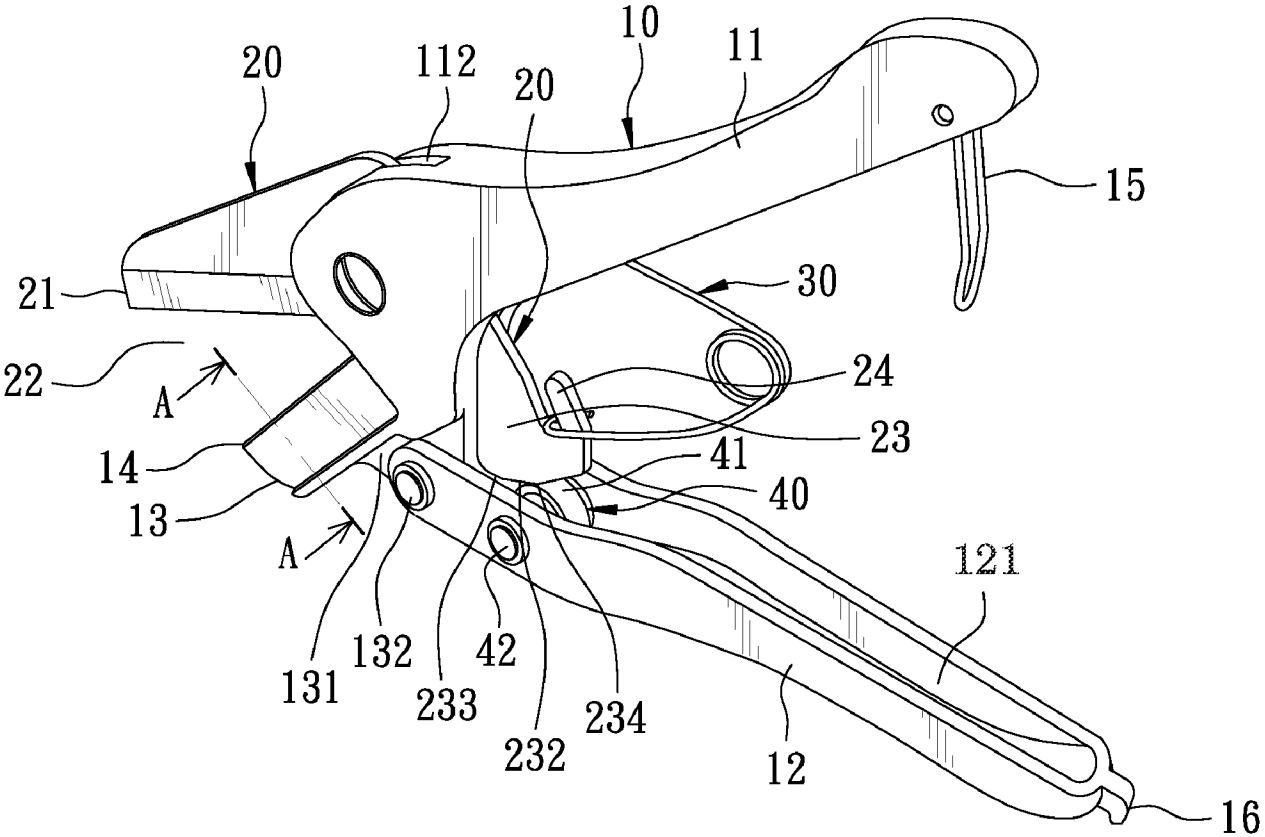
FIG. 3 is a perspective view of a pair of pipe cutting pincers in the present invention.
Figure 4:
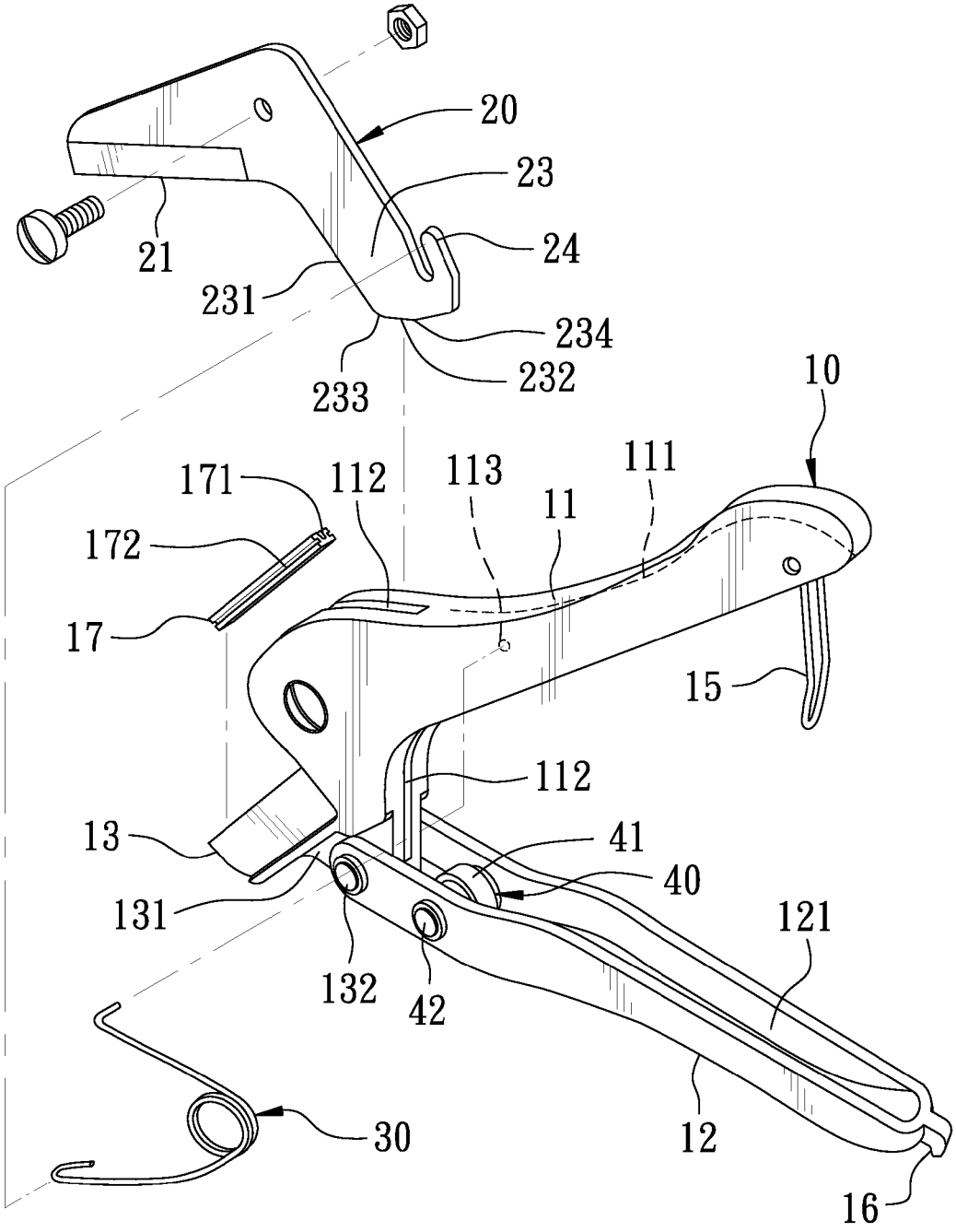
FIG. 4 is an exploded perspective view of the pipe cutting pincers in the present invention.

A preferred embodiment of a pair of pipe cutting pincers in the present invention, as shown in FIGS. 3 and 4, includes a pincers body 10, a pipe-cutting member 20, an elastic member 30 and a pivotal actuating member 40 as main components combined together.

The pincers body 10 consists of a first long shell-shaped handle 11 and a second long shell-shaped handle 12 pivotally assembled at a lower side of the first handle 11, and the first handle 11 and the second handle 12 have their opposite inner sides respectively bored with a first receiving groove 111 and a second receiving groove 121. The first handle 11 has its front end longitudinally bored with a pivotal groove 112 communicating with the first receiving groove 111 and formed integral with a pipe-cutting base 13 extending outward at a location corresponding to the front end of the pivotal groove 112 and adjacent to the second handle 12. The first receiving groove 111 has its inner wall bored with a circular hole 113 at a location near the pivotal groove 112, and the pipe-cutting base 13 has its topside cut with a pipe cutter groove 14 parallel to the first handle 11 and its lower side, opposite to the pipe- cutting groove 14, extended downward to form a semi-circular arcuate pivotal block 131 to be received in the front end of the second receiving groove 121. A pivot 132 is transversely inserted through the pivotal block 131 for pivotally assembling the second handle 12 on the first handle 11 to enable the second handle 12 to be swung up and down, and the pivotal groove 112 of the first handle 11 is extended into the pivotal block 131. Further, the first receiving groove 111 at the rear end of the first handle 11 has its opposite inner sides respectively hooked thereon with two free ends of a U-shaped clasp 15, while the second handle 12 has its rear end fixed with a hook 16 bent downward and extended outward at a location matching with the U-shaped clasp 15 of the first handle 11 so that when the pipe cutting pincers are not used, the U-shaped clasp 15 can be clasped with the hook 16 for facilitating storing the pipe cutting pincers.

Figure 5:
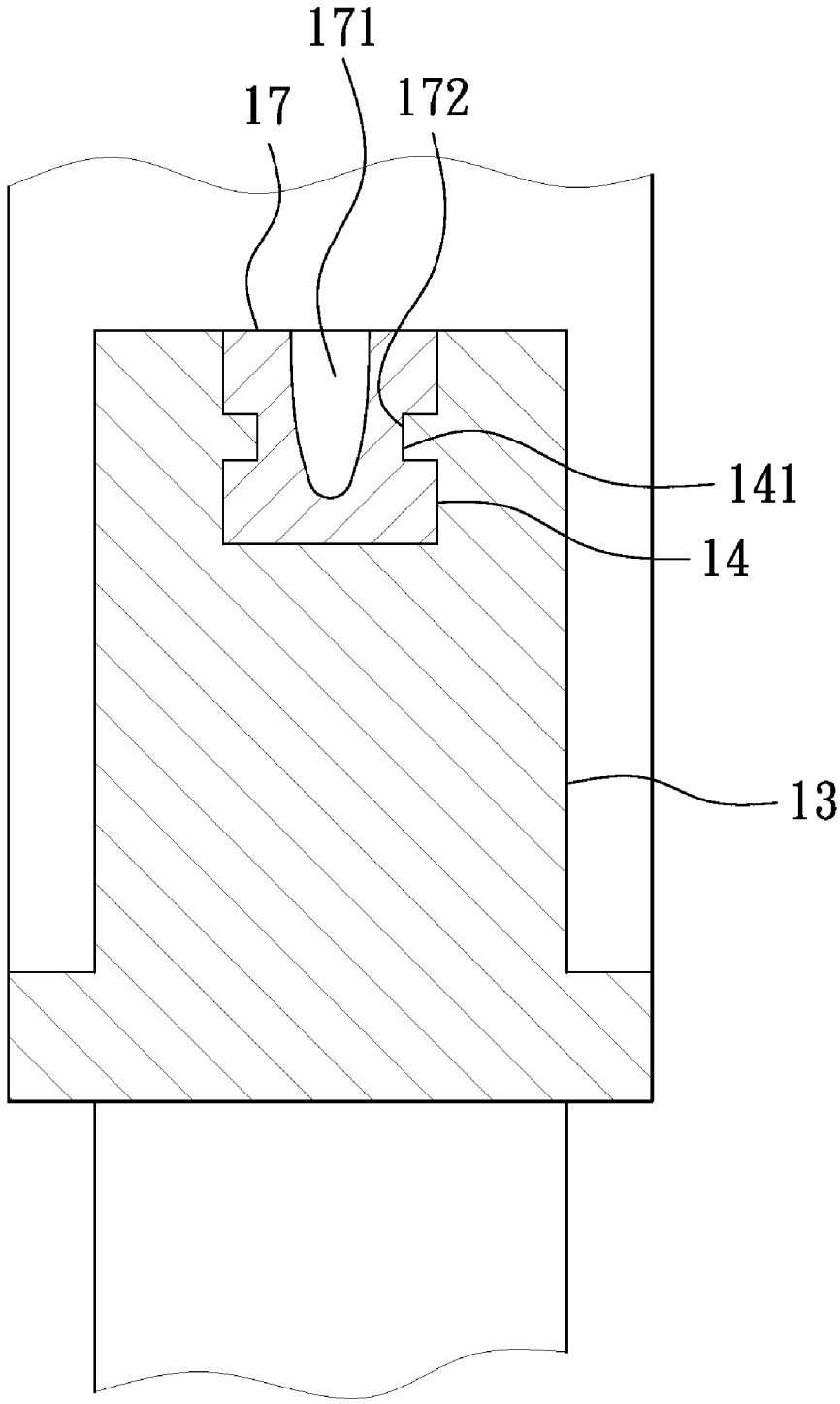
FIG. 5 is a cross-sectional view of the line A-A in FIG. 3.

Referring to FIGS. 3, 4 and 5, the pipe cutter groove 14 of the pipe-cutting base 13 is fitted therein with a rubber protective bar 17 bored with a U-shaped lengthwise recess 171 parallel to the pipe cutter groove 14 for receiving the pipe-cutting member 20 therein. The pipe cutter groove 14 has two opposite sides respectively and transversely fixed thereon with a rectangular position-limiting projection 141 extending toward the center, while the protective bar 17 has two opposite sides respectively cut with a lengthwise engage recess 172 matching with the position-limiting projection 141. Thus, the protective bar 17 can be inserted in the pipe cutter groove 14 from a front end and secured therein by mutual engagement of the position-limiting projections 141 and the engage recesses 172.

The pipe-cutting member 20, as shown in FIGS. 3 and 4, is an L-shaped curved blade received in the pivotal groove 112 and having its curved portion pivotally assembled in the pivotal groove 112 to enable the curved blade to be pivotally moved up and down slantwise. The pipe-cutting member 20 has its front end extended forward and positioned above the pipe-cutting base 13 and formed with a cutting edge 21 at a location opposite to the pipe-cutting base 13, with a pincers mouth 22 formed between the pipe-cutting member 20 and the pipe-cutting base 13. In addition, the pipe- cutting member 20 has its rear end gradually bent and extended toward the second receiving groove 121 to form a pivotally driven member 23, which has the lower end of its inner side facing the pincers mouth 22 and resisting against the lower inner wall of the pivotal groove 112 in the pivotal block 131. The pivotally driven member 23 has one side, opposite to the second receiving groove 121, formed with a slanting slide surface 232 having the inside corner of its front end formed with an arcuate chamfer-angle push-resist surface 233 and the lower side of its rear end slanting upward slightly to form a resisting member 234. The pivotally driven member 23 further has its rear end extended backward and then bent upward to form a hook pull member 24.

The elastic member 30 is a torsion spring positioned between the first handle 11 and the second handle 12, having two free ends respectively bent and hooked with the circular hole 113 in the inner wall of the first receiving groove 111 and on the pull member 24 at the rear end of the pivotally driven member 23 for actuating the pivotally driven member 23 to shift to and fro.

The pivotal actuating member 40 consists of a rotary wheel 41 rotatably assembled on a support rod 42 having its opposite ends transversely secured on the opposite inner walls of the second receiving groove 121 and positioned near the pivot 132 for pushing against the slide surface 232 of pivotally driven member 23. The pivotal rotation direction of the pivotal actuating member 40 is parallel to the diametrical direction of the pipe placed in the pincers mouth 22.

Referring to FIG. 3, when the pipe cutting pincers are not used and the U-shaped clasp 15 is not clasped with the hook 16, the pivotally driven member 23 of the pipe-cutting member 20 has the lower end of its inner side 231 resting on the lower inner wall of the pivotal groove 112 in the pivotal block 131, and the resisting member 234 at the rear end of the slide surface 232 of the pivotally driven member 23 resists against the rotary wheel 41 for restricting the pipe-cutting member 20 in position.

Figure 6:
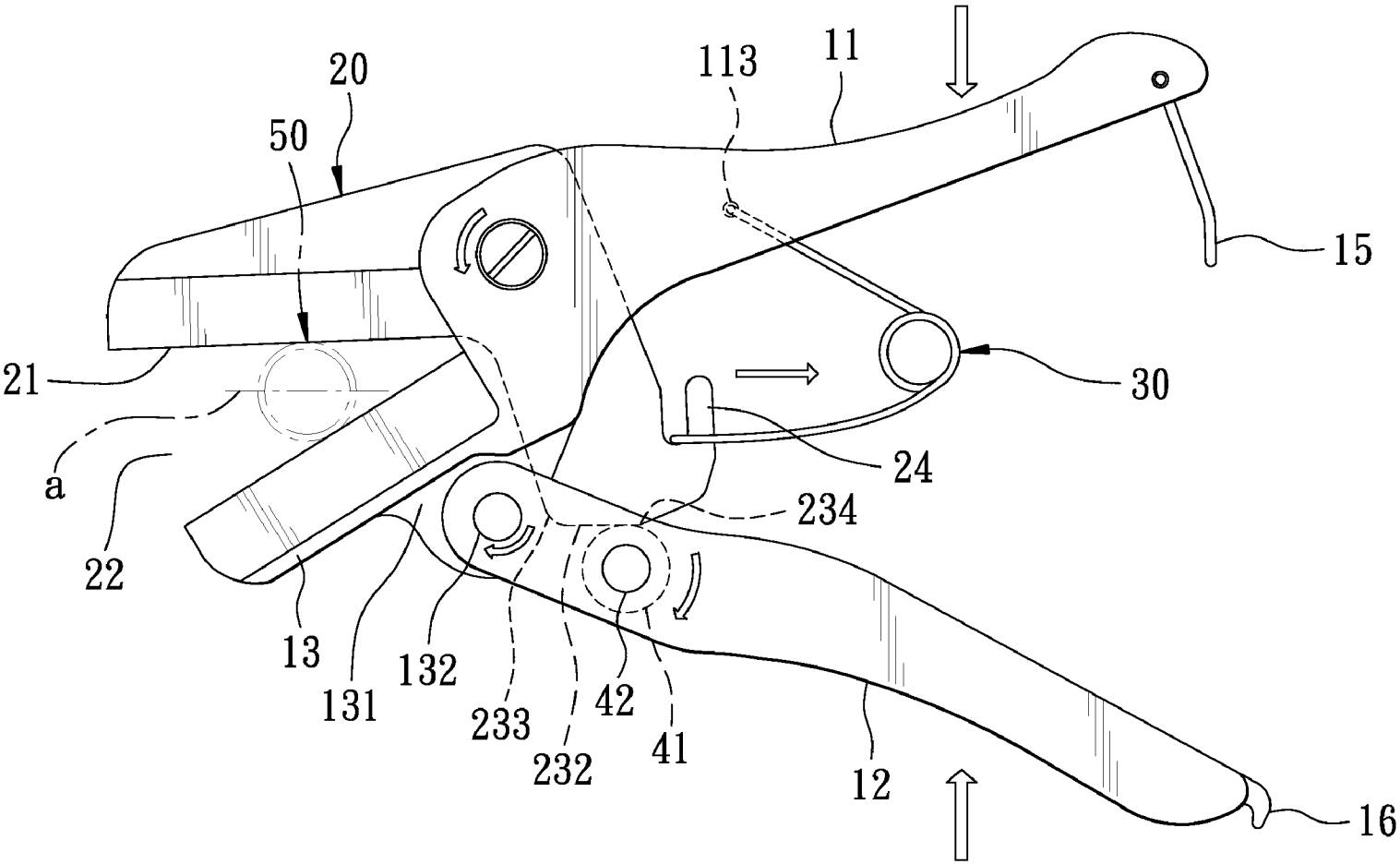
FIG. 6 is a perspective view of the pipe cutting pincers in a first using condition in the present invention.
Figure 7:
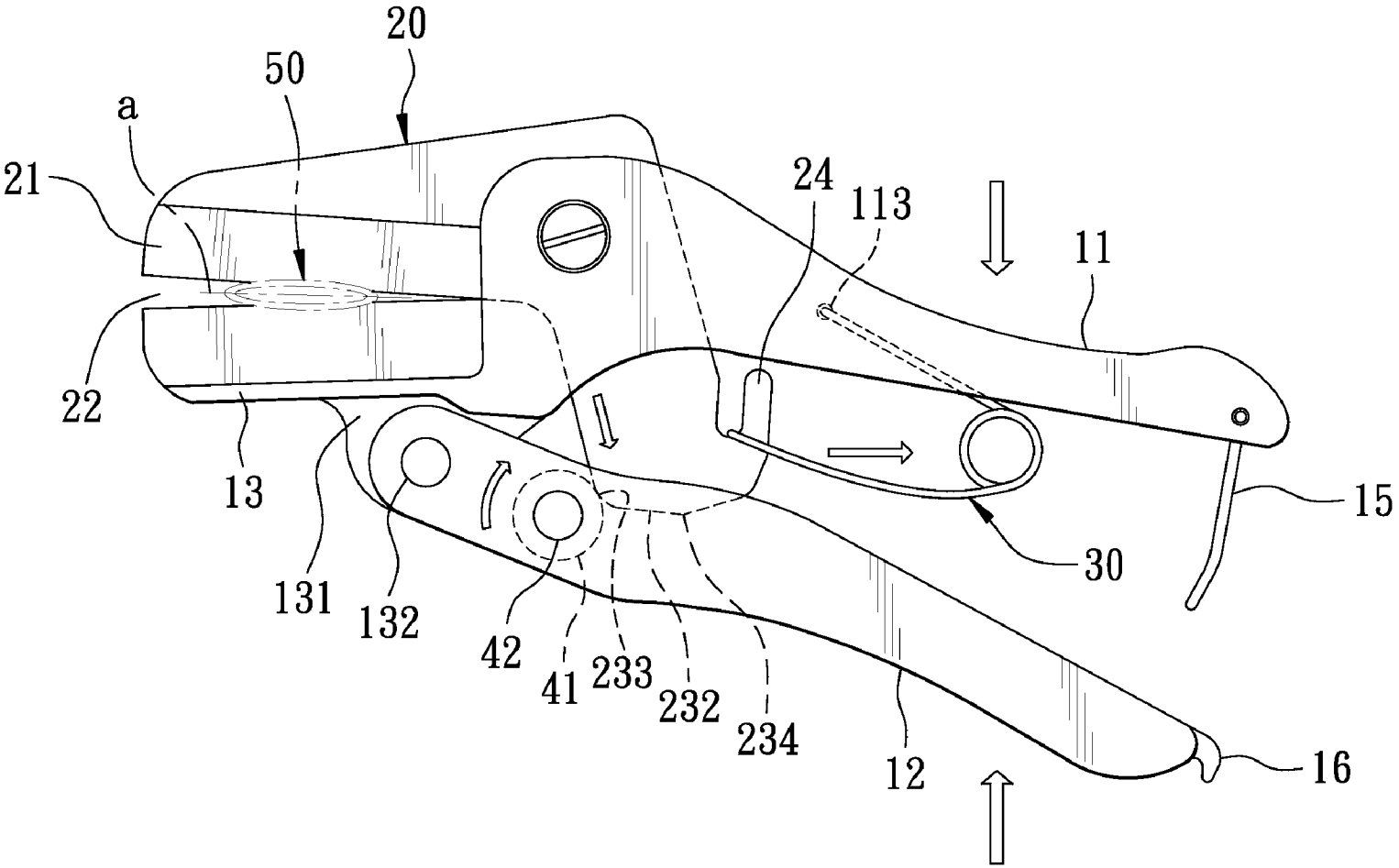
FIG. 7 is a perspective view of the pipe cutting pincers in a second using condition in the present invention.

To cut off a pipe 50 (a plastic pipe), as shown in FIGS. 6 and 7, firstly, hold the upper end of the first handle 11 and that of the second handle 12 and place the pipe 50 to be cut at a location in a diametrical direction (a) that is parallel to the cutting edge 21. Next, the second handle 12 is pivotally pressed to move toward the first handle 11 to let the pincers mouth 22 clamp the pipe 50 and then the second handle 12 is continuously pressed back and forth to actuate the pipe-cutting member 20 to move up and down slantwise by reciprocating pulling of the elastic member 30.

Simultaneously, the slide surface 232 of the pivotally driven member 23 will resist against the pivotal actuating member 40, and when the pivotal actuating member 40 is pivotally rotated and the pipe 50 is being cut to let the pincers mouth 22 become smaller and smaller, the push-resist surface 233 will be actuated to push the pivotal actuating member 40 to move the pivotally driven member 23 backward to be positioned at the rear side of the pivotal actuating member 40, and synchronously the cutting edge 21 will gradually cut off the pipe 50 in a diametrical direction.

By so designing, when the second handle is axially and pivotally pressed, the elastic member will be actuated to repeatedly pull the pivotally driven member to move and make the pivotal actuating member to rotate and actuate the cutting edge to cut off the pipe, convenient and labor-saving in operating, and simple in structure as well as in assembly.

While the preferred embodiment of the invention has been described above, it will be recognized and understood that various modifications may be made therein and the appended claims are intended to cover all such modifications that may fall within the spirit and scope of the invention.

I claim:

1. A pair of pipe cutting pincers comprising:

a pincers body provided with a first long shell-shaped handle and a second long shell-shaped handle, said second handle pivotally assembled at one side of said first handle, said first handle and said second handle having their opposite sides respectively bored with a first receiving groove and a second receiving groove, said first handle having its front end cut with a pivotal groove communicating with said first receiving groove, said first handle extended forward and formed with a pipe-cutting base at a location opposite to a front end of said pivotal groove and near said second handle, said pipe-cutting base having its topside axially disposed with a pipe cutter groove;

a pipe-cutting member being an L-shaped blade received in said pivotal groove, said pipe-cutting member having its curved portion pivotally fixed in said pivotal groove, said pipe-cutting member having its front end extended outward and positioned above said pipe-cutting base, said pipe-cutting member formed with a cutting edge corresponding to said pipe-cutting base, between said cutting edge and said pipe-cutting base formed a pincers mouth, said pipe-cutting member having another end bent and extended toward said second receiving groove to form a pivotally driven member, said pivotally driven member having its bent inner side resting on an inner wall of said pivotal groove;

an elastic member positioned between said first handle and said second handle, said elastic member having one end hooked with said first receiving groove and another end hooked with a rear end of said pivotally driven member; and a pivotal actuating member rotatably assembled at a preset location in said second receiving groove, said pivotal actuating member resisting against a lower end of said pivotally driven member.

2. The pipe cutting pincers as claimed in claim 1, wherein said elastic member is a torsion spring having two opposite ends respectively hooked with said first receiving groove and one end of said pivotally driven member.

3. The pipe cutting pincers as claimed in claim 1, wherein said pivotally driven member is provided with a slanting slide surface at one side corresponding with said pivotal actuating member and an arcuate chamfer-angle push-resist surface abutting an inside corner of said slanting slide surface.

4. The pipe cutting pincers as claimed in claim 1, wherein said pipe cutter groove is fitted therein with a rubber protective bar bored with a U-shaped recess tallying with a width of said cutting edge.

5. The pipe cutting pincers as claimed in claim 4, wherein said pipe cutter groove has two opposite lengthwise sides respectively disposed with a rectangular position-limiting projection protruding outward transversely, while said protective bar has two opposite lengthwise sides respectively bored with an engage recess matching with said position-limiting projection.

6. The pipe cutting pincers as claimed in claim 1, wherein said pipe-cutting base has an end opposite to said pipe cutter groove fixed with a semi-circular arcuate pivotal block protruding downward and received in a front end of said second receiving groove for said second handle to be pivotally assembled on said first handle.

7. The pipe cutting pincers as claimed in claim 6, wherein said pivotal groove of said first handle is extended in said semi-circular arcuate pivotal block, and said pivotally driven member has its curved inner side resisting against an inner wall of said semi-circular arcuate pivotal block.

8. The pipe cutting pincers as claimed in claim 1, wherein said pivotal actuating member consists of a rotary wheel rotatably assembled on a support rod having two opposite ends fixed in said second receiving groove.

9. The pipe cutting pincers as claimed in claim 1, wherein said first receiving groove at a rear end of said first handle has its opposite sides respectively hooked with two free ends of a U-shaped clasp, while said second handle has its rear lower end secured with a hook protruding outward for said U-shaped clasp to be clasped thereon.

* * * * *